US005561264A

United States Patent [19]

Iino et al.

[11] Patent Number: 5,561,264

[45] Date of Patent: Oct. 1, 1996

[54] LIQUID-TYPE DEVELOPING DEVICE

[75] Inventors: Shuji Iino, Muko; Toshimitsu Fujiwara; Hidetoshi Miyamoto, both of Takatsuki; Takaji Kurita, Osakasayama, all of Japan

[73] Assignee: Minolta Co., Ltd., Osaka, Japan

[21] Appl. No.: 538,902

[22] Filed: Oct. 4, 1995

[30] Foreign Application Priority Data

Oct. 7, 1994 [JP] Japan ..... 6-244160
Oct. 11, 1994 [JP] Japan ..... 6-245635

[51] Int. Cl.[6] ..... G03G 15/10

[52] U.S. Cl. ..... 118/661; 355/256; 355/261; 118/647

[58] Field of Search ..... 118/661, 647; 355/256, 327, 261; 430/117–119

[56] References Cited

U.S. PATENT DOCUMENTS 3,722,993 3/1973 Egnaczak .
3,876,116 4/1975 Kushima et al. .
4,259,005 3/1981 Kuehnle ..... 118/661 X
4,860,050 8/1989 Kurotori et al. .
4,878,090 10/1989 Lunde ..... 355/256
4,942,475 7/1990 Uematsu et al. ..... 355/256
5,289,238 2/1994 Lior et al. .
5,291,250 3/1994 Nishikawa et al. .

*Primary Examiner*—R. L. Moses
*Attorney, Agent, or Firm*—McDermott, Will & Emery

[57] ABSTRACT

A liquid-type developing device for use in an image forming apparatus such as a copying machine or printer, that develops an electrostatic latent image formed on a latent image holding member using a liquid-type developer. In the liquid-type developing device, a developer carrying member supplies the liquid-type developer to the surface of the electrostatic latent image carrier at a developing region, and a removing member removes residual liquid-type developer remained on the surface of the developer carrying member after development.

Before removing the residual liquid-type developer remained by the removing member, a fluid supplying member supplies a fluid on the surface of the developer carrying member so that the removing member removes said residual liquid-type developer with said fluid.

23 Claims, 12 Drawing Sheets

LIQUID-TYPE DEVELOPING DEVICE

BACKGROUND OF THE INVENTION

1. Field of the Invention

This invention relates to a liquid-type developing device that develops an electrostatic latent image formed on a latent image holding member using toner dispersed within a medium.

2. Description of the Related Arts

Conventionally, in electrophotography or electrostatic recording, a liquid-type developing device has been known that develops an electrostatic latent image using liquid-type developing agent that includes toner particles and a liquid medium to disperse those toner particles.

In this type of liquid-type developing device, for instance, the liquid-type developer is held on the surface of a roller shaped developing agent holding member called a developing roller, fed to opposing portions of a photoreceptor drum which is the electrostatic latent image holding member after which the electrostatic latent image is developed.

When the electrostatic latent image is developed by means of the liquid-type developing device, a layer of liquid-type developer with uniform density must be formed on the surface of the developing roller. Thus, there is a possibility the image may degrade if the state or density of the layer of developing agent retained on the surface of the developing roller changes.

SUMMARY OF THE INVENTION

The purpose of this invention is to provide a liquid-type developing device that can reliably output favorable images.

Another object of this invention is to stabilize the developing state of the liquid-type developing device and achieve favorable developing.

A further object of this invention is to prevent liquid-type developer from remaining on the developing roller and uneven density of the liquid-type developer to form a layer of liquid-type developer with uniform density on the surface of the developing roller.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

In the following description, like parts are designated by like reference numbers throughout the several drawings.

DESCRIPTION OF THE PREFERRED EMBODIMENTS

<Construction of the apparatus>

Figure 1:
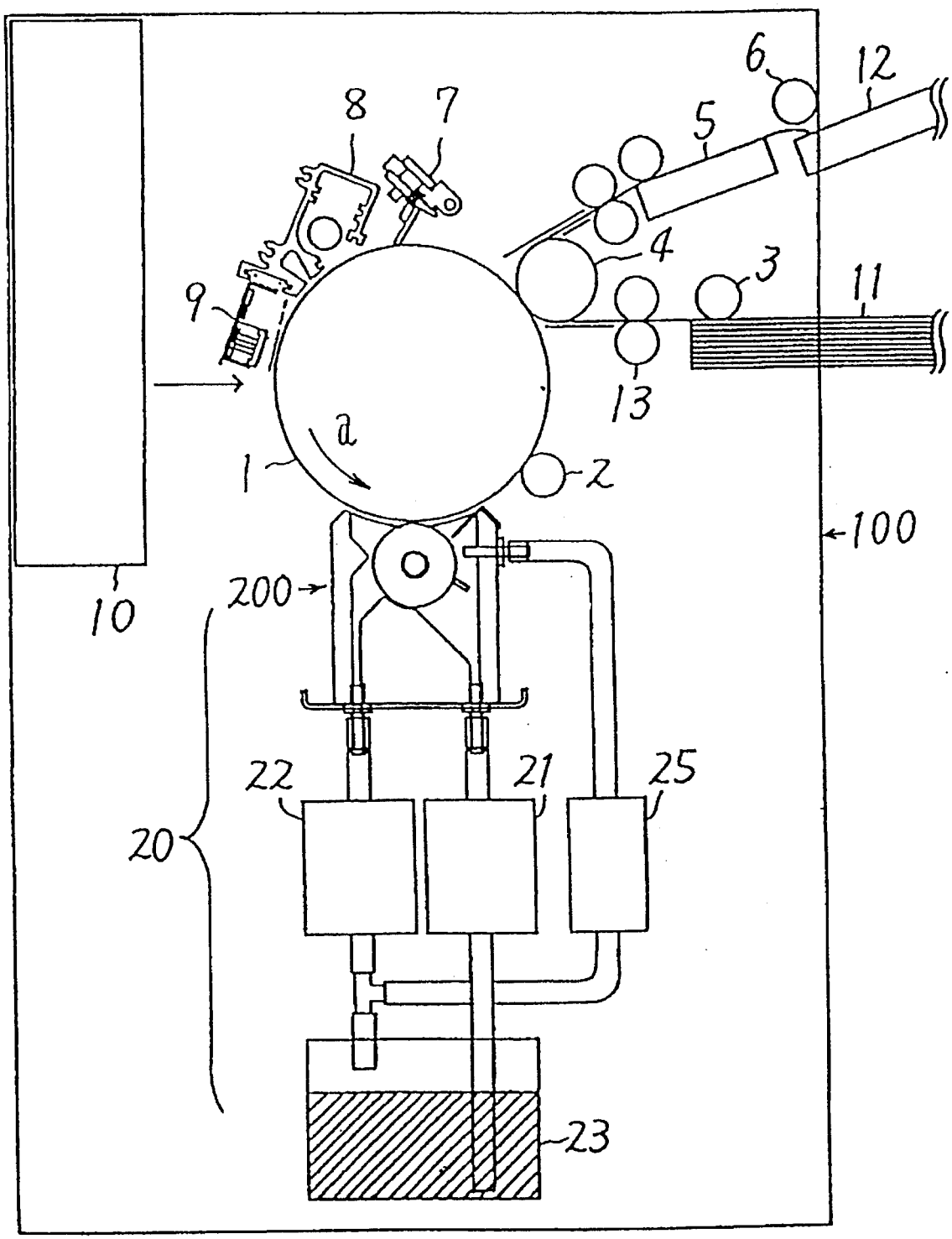
FIG. 1 is a cross-sectional view of a wet-type electrophotographic printer 100 to which this invention was applied.

FIG. 1 is a cross-sectional view of an electrophotographic printer 100 incorporating the liquid-type developing device to which this invention was applied. As shown in FIG. 1, inside the printer 100, a cylindrical photoreceptor drum 1 rotatable in the direction of arrow a shown in the figure is provided on whose surface electrostatic latent images form. On the circumference of the photoreceptor drum 1 are arranged in order a laser generation device 10 that generates a laser beam based on image data sent from a host computer (not shown in figure), the liquid-type developing device 20 which is the processor to form images, a squeeze roller 2, a transfer roller 4, a cleaner 7, a charge eraser lamp 8 and an electric charger 9. Further, on one side of the printer 100 are provided a paper storage cassette 11 that stores paper inside a fixing device 5 to fix toner images formed on the paper and a delivery tray 12 onto which paper expelled from inside the printer is loaded.

The operation of the printer 100 is described below.

The photoreceptor drum 1 begins rotation at a fixed speed in the direction of arrow a and then after being uniformly charged by means of the electric charger 9, an electrostatic latent image is formed on the surface of the drum by means of the drum being irradiated by the laser beam from the laser generation device 10. This electrostatic latent image becomes apparent by means of the liquid-type developing device 20 using liquid-type developer and then any remaining liquid medium is removed by means of the squeeze roller 2.

Conversely, a feeding roller 3 provided close to the paper storage cassette 11 also begins rotation feeding paper from the paper storage cassette 11 to the inside of the printer. Then, a timing roller 13 synchronizes the feed with the toner image forming on the photoreceptor 1 feeding the paper in the direction toward the opposing portions of the photoreceptor 1 and the transfer roller 4. The toner image on the photoreceptor 1 is then transferred to the paper by means of the transfer roller 4 onto which a voltage opposite to the charge polarity of the toner was applied. The paper that completed the transfer is dried by means of the fixing device 5 along with the toner image transferred to its surface being fixed and then is expelled from a delivery roller 6 to the delivery tray 12.

After completing the transfer of the toner image, the photoreceptor drum 1 prepares for the next print by means of the cleaner 7 removing any developing agent remaining on the surface of the drum and the charge eraser lamp 8 removing any charge remaining on the surface. This is how a series of prints completes.

Figure 2:
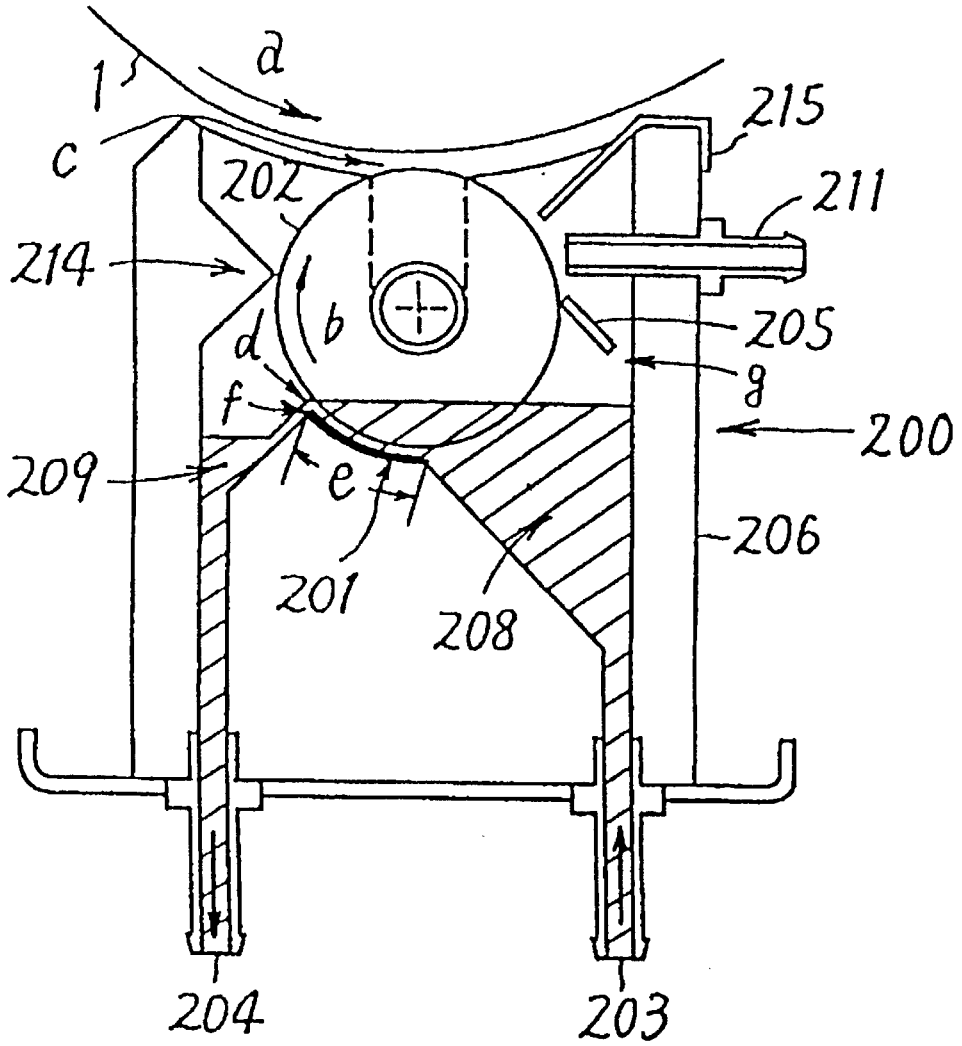
FIG. 2 is an enlarged view of the periphery of the liquid-type developing device 20 of the printer 100.

As shown in FIG. 1, the liquid-type developing device 20 comprises a liquid-type developer storage tank 23 to store liquid-type developer, a liquid supply device 21 that draws up liquid-type developer inside the liquid-type developer storage tank 23, a developing head 200 opposite the photoreceptor drum 1 and develops the electrostatic latent image on the photoreceptor 1 using the liquid-type developer supplied by means of the liquid supply device 21, a liquid transport device 22 to return liquid-type developer inside the developing head 200 to the liquid-type developer storage tank 23 and a cleaning solution supply device 25 that draws up one part of the liquid-type developer returned to the developing agent tank 23 by means of the liquid transport device 22 and then supplies this to the inside of the developing head 200 as cleaning solution. Moreover, the liquid-type developer inside the liquid-type developer storage tank 23 is maintained at an almost even toner density and liquid quantity by means of a developing agent supply device (not shown in figure) supplying toner and carrier solution when required. FIG. 2 is an enlarged view of the periphery of the developing head 200. As shown in FIG. 2, the developing head 200 comprises a developing roller 202 to hold the liquid-type developer on the surface of the developing roller 202, a frame 206 that supports the developing roller 202, a liquid-type developer container 208 to store liquid-type developer, a liquid collecting container 209 that collects liquid-type developer overflowing from the liquid-type developer container 208, a cleaning blade 205 that scrapes off residual liquid-type developer remaining on the developing roller 202 and a nozzle 211 which sprays cleaning solution on the developing roller 202. Above the liquid collecting container 209, a liquid restricting member 214 is provided that restricts the amount of the liquid-type developer on the surface of the developing roller 202 and drops an excess amount of the liquid-type developer to the liquid collecting container 209. The diagonal line portion indicates the liquid-type developer.

Figure 3:
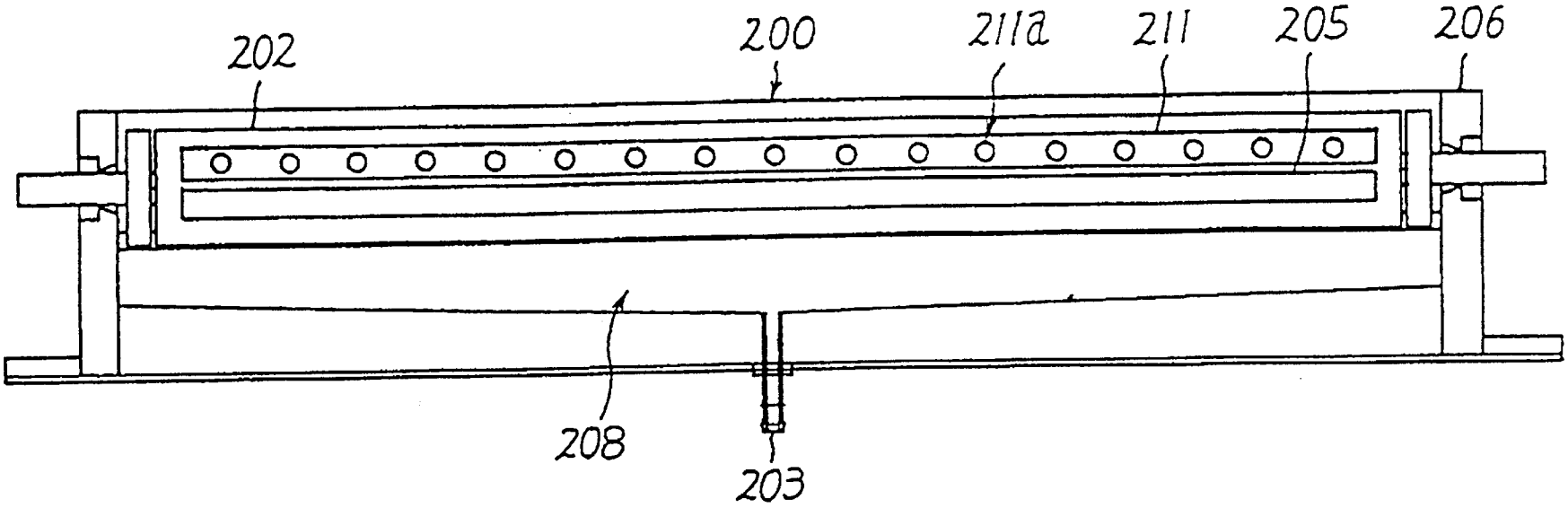
FIG. 3 shows the construction in the longitudinal direction of the developing head 200.

The developing roller 202 manufactured in a cylindrical shape from a conductive material is arranged in parallel in the longitudinal direction of the photoreceptor drum 1 and is supported by means of a frame 206 to be rotatable in the direction of arrow b in the figure or, in other words, in the same direction as the rotation direction (arrow a) of the photoreceptor 1 in the opposing portions (hereinafter referred to as developing portion c) between the photoreceptor 1. Further, FIG. 3 shows the construction in the longitudinal direction of the developing head 200.

The gap between the photoreceptor 1 and the developing roller 202 in the developing portion c (hereinafter referred to as developing gap) can be freely set within a range of 0 to 2mm. When the developing gap is set to 0.1 to 2 mm, it becomes advantageous in view of the fog phenomenon as described later. If the developing gap is not provided and the photoreceptor and toner holding member make contact, it becomes advantageous in view of high-speed developing.

The liquid-type developer container 208 is provided below the developing roller 202. On the bottom of the liquid-type developer container 208 a liquid supply opening 203 is formed connected to the liquid supply device 21 and during developing, liquid-type developer is supplied from this liquid supply opening 203 to the liquid-type developer container 208. As shown in FIG. 2, the lower portion of the developing roller 202 is immersed in the liquid-type developer inside the liquid-type developer container 208.

One portion of the upper edge of the wall forming the liquid-type developer container 208 is adjacent to the lower portion of the developing roller 202 and forms frame portion f extending parallel in the longitudinal direction of the developing roller. After the liquid-type developer container 208 is filled with liquid-type developer, any excess liquid-type developer flows out from the frame portion f.

The inner wall of the liquid-type developer container 208 extending from the frame portion f to the opposing portions of the lowest point of the developing roller 202 is a circumferential surface 201 that maintains a fixed space between the developing roller 202. This circumferential surface forms an electrode 201 for forming the thin layer of the toner that applies a voltage between the developing roller 202 to make toner adhere to the surface of the developing roller 202.

After the liquid-type developer fills up a portion d where between the electrode 201 and the developing roller 202, toner particles with a remaining charge in the liquid-type developer are subjected to a static electric force and move toward the developing roller 202 by means of applying a voltage. This action forms a thin layer (thin layer of very high density liquid-type developer) of toner on the surface of the developing roller 202. Moreover, layer of liquid medium with almost no toner is formed on the surface of the thin layer of toner.

The voltage applied between the electrode 201 and the developing roller 202 can be a DC voltage, such as a voltage that superimposes alternating current on direct current as well as a voltage that superimposes pulsed voltage on direct current. The direct current component is 100 to 2000 V or more preferably 200 to 1500 V. When an alternating component is superimposed, the peak voltage is 200 to 4000 V or more preferably 400 to 3000 V and the frequency is 10 to 10,000 Hz.

Further, if the length of the portion d (range indicated by arrow e of FIG. 2) is set to 3 to 80 mm or more preferably 5 to 50 mm, sufficient time required for the toner to move to form the thin layer can be obtained making it possible to form a high-density liquid-type developer thin layer.

When the space between the electrode 201 and the developing roller 202 (hereinafter referred to as thin layer forming gap) is set to 0.1 to 10 mm or more preferably 0.3 to 3 mm, said liquid-type developer layer comprising a thin layer of toner and liquid medium layer can be formed while the liquid-type developer is flowing favorably to the portion d.

The liquid collecting container 209 is adjacent to the frame portion f and is designed such that the liquid-type developer flows into the liquid collecting container 209 from the liquid-type developer container 208 over the frame portion f. On the bottom of the liquid collecting container 209, a liquid transport opening 204 connected to the liquid transport device 22 is formed. The liquid-type developer which flowed into the liquid collecting container 209 is transported through this liquid transport opening 204 to the liquid-type developer storage tank 23 shown in FIG. 1.

Above the liquid-type developer container 208 a cleaning blade 205 is provided to scrape off liquid-type developer remaining on the developing roller 202. The upper edge of the blade makes contact with the top of the developing roller 202. Between the lower edge of the cleaning blade 205 and frame 206, a gap g is provided so liquid-type developer which was scraped off drops down to the liquid-type developer container 208. In this embodiment, although a blade is used to scrape off the liquid-type developer, a roller or brush can also be used.

Above the cleaning blade 205, a nozzle 211 that connects to the cleaning solution supply device 25 is provided. As shown in FIG. 3, the nozzle 211 comprises a plurality of expulsion openings 211*a* at fixed intervals in the longitudinal direction of the developing roller 202. The expulsion openings 211*a* face toward the developing roller 202.

Above the nozzle 211, an evaporation prevention panel 215 that prevents evaporation of the liquid-type developer inside the developing head 200 is provided. The evaporation prevention panel 215 is fixed to the frame 206 and its leading edge extends close to the developing roller 202.

Next, the operation of the liquid developing device 20 will be described in detail.

When developing starts, the liquid supply device 21 operates supplying liquid-type developer from the liquid supply opening 203 to the liquid-type developer container 208. After the liquid-type developer passes through the portion d and liquid collecting container 209, the liquid transport device 22 transports the liquid-type developer through the liquid transport opening 204 to the liquid-type developer storage tank 23 and then the liquid supply device 21 supplies the liquid-type developer to the developing head 200 again. In this way, the liquid-type developer circulates inside the developing apparatus 20 during developing.

The liquid transport capacity of the liquid transport device 22 in the developing apparatus 20 is more than the liquid supply capacity of the liquid supply device 21. Therefore, as shown in FIG. 2, the liquid surface of the liquid-type developer inside the developing head 200 is almost uniform making the location slightly exceeding the frame portion f (or the upper edge of the electrode 201) of the liquid-type developer container 208 as the highest position.

On the other hand, the start of developing is accompanied by the developing roller 202 starting to rotate in the direction of arrow b. Further, while the liquid-type developer passes through the portion d and a fixed voltage is applied between the electrode 201 and the developing roller 202, and toner particles with a charge in the liquid-type developer are subjected to a static electric force and moved toward the developing roller 202. This action forms a thin layer of toner on the surface of the developing roller 202. Moreover, layer of liquid medium with almost no toner is formed on the surface of the thin layer of toner. The liquid-type developer layer that was formed in this way is transferred to the developing portion c by means of the rotation of the developing roller 202 after restricted by means of the liquid restricting member 214.

A fixed developing bias voltage is applied to the developing roller 202 which causes the electrostatic latent image on the photoreceptor 1 in the developing portion c to form an electric field which results in the toner flowing from the developing roller 202 onto the photoreceptor 1 where the surface of the latent image adheres by means of the coulomb energy developing the electrostatic latent image.

In particular, when the developing gap is 0.1 to 2 mm, the liquid medium layer within the liquid-type developer layer being held on the developing roller 202 makes contact with the surface of the photoreceptor 1 with toner passing through the liquid medium layer from the toner thin layer and flowing onto the photoreceptor 1. Consequently, the toner thin layer does not make direct contact with the photoreceptor 1 allowing the generation of the fog to be controlled.

At first, cleaning solution is sprayed from the cleaning solution supply opening 211 in the portion that passed through the developing portion c of the developing roller 202. By spraying cleaning solution, the layer of liquid-type developer remaining on the surface of the developing roller 202 is broken up making it easy to scrape off the liquid-type developer.

Next, liquid-type developer remaining on the developing roller 202 is scraped off by means of the cleaning blade 205 dropping from gap g toward the liquid-type developer container 208.

When developing completes in this way, the application of voltage stops along with the operations of the liquid supply device 21, the liquid transport device 22, the cleaning solution supply device 25 and the developing roller 202 stopping. Thus, the liquid-type developer inside the liquid-type developer container 208 quickly drops from the liquid supply opening 203 and liquid transport opening 204 to the liquid-type developer storage tank 23 by its own weight.

Furthermore, in the printer in FIG. 1, the cleaning solution supply device 25 draws up one portion of the liquid-type developer which the liquid transport device 22 returns from the liquid collecting container 209 to the liquid-type developer tank 23. The liquid-type developer supplied as cleaning solution contains the excess amount of the liquid-type developer which is dropped from the surface of the developing roller 202 to the liquid collecting container 209 by the liquid restricting member 214. Further, because a large amount of toner in the liquid-type developer on the surface of the developing roller 202 is attracted onto the developing roller 202 in the portion d by static electricity, the excess amount of the liquid-type developer which is dropped by the liquid restricting member 214 contains a small amount of toner and is a low viscosity liquid applicable to a cleaning solution. This is supplied to the inside of the developing head 200 as cleaning solution although, in its place, the liquid-type developer inside the liquid-type developer storage tank 23 can be drawn up directly using a pump and used as cleaning solution. Moreover, either a supply liquid to make the density of the liquid-type developer uniform, namely, the liquid medium itself, liquid medium into which is added a charge control agent or a liquid medium with a high toner density can be used. Furthermore, a special solution specially prepared for the purpose of cleaning, namely, a solution comprising mainly of liquid medium comprising liquid-type developer, into which a charge control agent, dispersal agent or toner is included as required can also be used.

The most preferable rotation speed of the developing roller 202 is almost the same speed as the rotation speed of the photoreceptor 1. When used in this way, shearing force is not applied to the toner that would adhere to the photoreceptor 1 thus, image distortions can be kept at a minimum. Further, if required, the rotation speeds of both the developing roller 202 and the photoreceptor 1 can be made different. If the developing roller 202 rotates faster than the photoreceptor 1, the quantity of toner supplied to the photoreceptor 1 can be increased. If the developing roller 202 rotates slower than the photoreceptor 1, the quantity of toner supplied to the photoreceptor 1 can be decreased. Moreover, the developing roller 202 can be made to rotate in the direction which is reverse to the direction the photoreceptor 1 rotates in the opposing portions of the photoreceptor 1. When used in this way, the quantity of toner adhering to the photoreceptor 1 can be reduced.

The surface roughness of the developing roller 202 should be a ten-point surface roughness (RZ) of 5 μm or less. When the surface roughness (RZ) is set to this value, the following problems can be prevented: image distortion due to contact between the photoreceptor 1 and the developing roller 202, damage to the thin toner layer due to contact between the developing roller 202 and electrode 201, uneven developing due to a non-uniform electric field in the developing portion c, uneven thin toner layer due to non-uniform electric field in the portion d, and uneven cleaning due to the cleaning blade 205. The ten-point surface roughness (RZ) is defined in JIS standard B0601.

Further, when said liquid-type developer layer formed by the thin toner layer and liquid medium layer contains toner with magnetic properties, the action of the magnetic field can also be used to form the thin toner layer. Methods other than these can also be used freely, for example, the thin toner layer can be formed using a mechanical method shown next.

Figure 4:
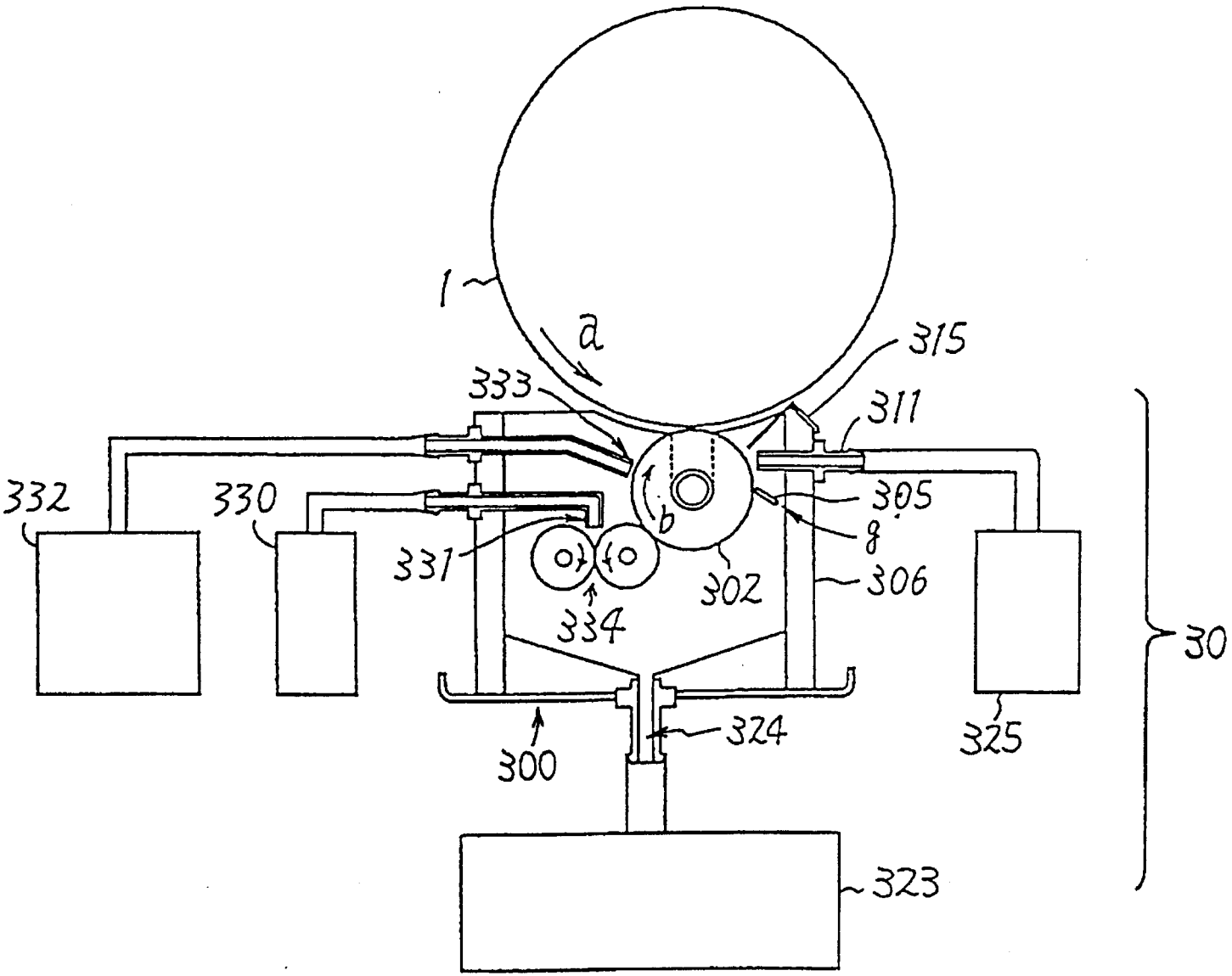
FIG. 4 is an enlarged view of the periphery of the liquid-type developing device 30.

FIG. 4 is a cross-sectional view of the liquid-type developing device 30 which is modification of the developing apparatus 20 shown in FIG. 2 so that the liquid-type developer is applied to the developing roller by means of a mechanical method that is different from the electrical method performed in the developing apparatus 20. As shown in FIG. 4, the liquid-type developing device 30 comprises a developing head 300, a developing roller 302 and a frame 306 identical to the developing apparatus 20 shown in FIGS. 1 and 2.

A pair of application rollers 334 are provided in the developing head 300 to apply the liquid-type developer to the developing roller 302. One side of the application rollers 334 makes contact with the developing roller 302.

Inside the developing head 300, a liquid-type developer supply opening 331 is provided facing toward the nip portion of the application rollers 334. The liquid-type developer supply opening 331 is connected to the liquid-type developer supply apparatus 330 and comprises a plurality of openings in the longitudinal direction of the developing roller 302. Liquid-type developer with a high toner density is supplied from this opening onto the application rollers 334.

A liquid medium supply opening 333 is provided adjacent to the developing roller 302 on the downstream side of the application rollers 334 relative to the rotation direction (direction of arrow b in the figure) of the developing roller 302. The liquid medium supply opening 333 is connected to a liquid medium supply apparatus 332. The liquid medium supply opening 333 also comprises a plurality of openings in the longitudinal direction of the developing roller 302 and supplies liquid medium from the opening onto the developing roller 302.

Under the developing roller 302 a liquid transport opening 324 is provided. Liquid-type developer inside the developing head 300 passes through this liquid transport opening 324 and is transported to a liquid transport device 323.

A nozzle 311 is connected to a cleaning solution supply device 325, a cleaning blade 305 and an evaporation prevention panel 315 respectively have similar construction to those of the liquid-type developing device 20 shown in FIG. 2.

When the developing starts, the developing roller 302 and application rollers 334 start rotating.

Next, the liquid-type developer supply apparatus 330 operates and liquid-type developer with a high toner density is supplied from the liquid-type developer supply opening 331 to the application rollers 334.

By the application rollers 334 rotating in directions opposite to each other, liquid-type developer supplied from the liquid-type developer supply opening 331 is made to pass through the nip portion evenly spreading on the application rollers 334. Then, the liquid-type developer is mechanically transferred to the developing roller 302 which is making contact with the application rollers 334 forming a thin toner layer on the developing roller 302. The action of a supplemental electric field or magnetic field can be used while the toner layer transfers from the application rollers 334 to the developing roller 302.

Continuing further, the liquid medium supply apparatus 332 operates supplying liquid medium from the liquid supply opening 333 to the developing roller 302 where a thin toner layer is formed. This action forms a liquid-type developer layer on the surface of the developing roller 302 containing a thin toner layer and liquid medium layer with almost no toner on the surface of the said thin toner layer.

By the liquid-type developer layer formed on the developing roller 302 making contact with the photoreceptor 1 in this way, developing occurs in the same manner as described in the previous embodiment. Next, after cleaning solution is sprayed from the nozzle 311 to the developing roller 302, the cleaning blade 305 scrapes off any liquid-type developer remaining on the developing roller 302. The scraped off agent drops downward from gap g, passes through liquid transport opening 324 and is transported by means of the liquid transport device 323.

Figure 5:
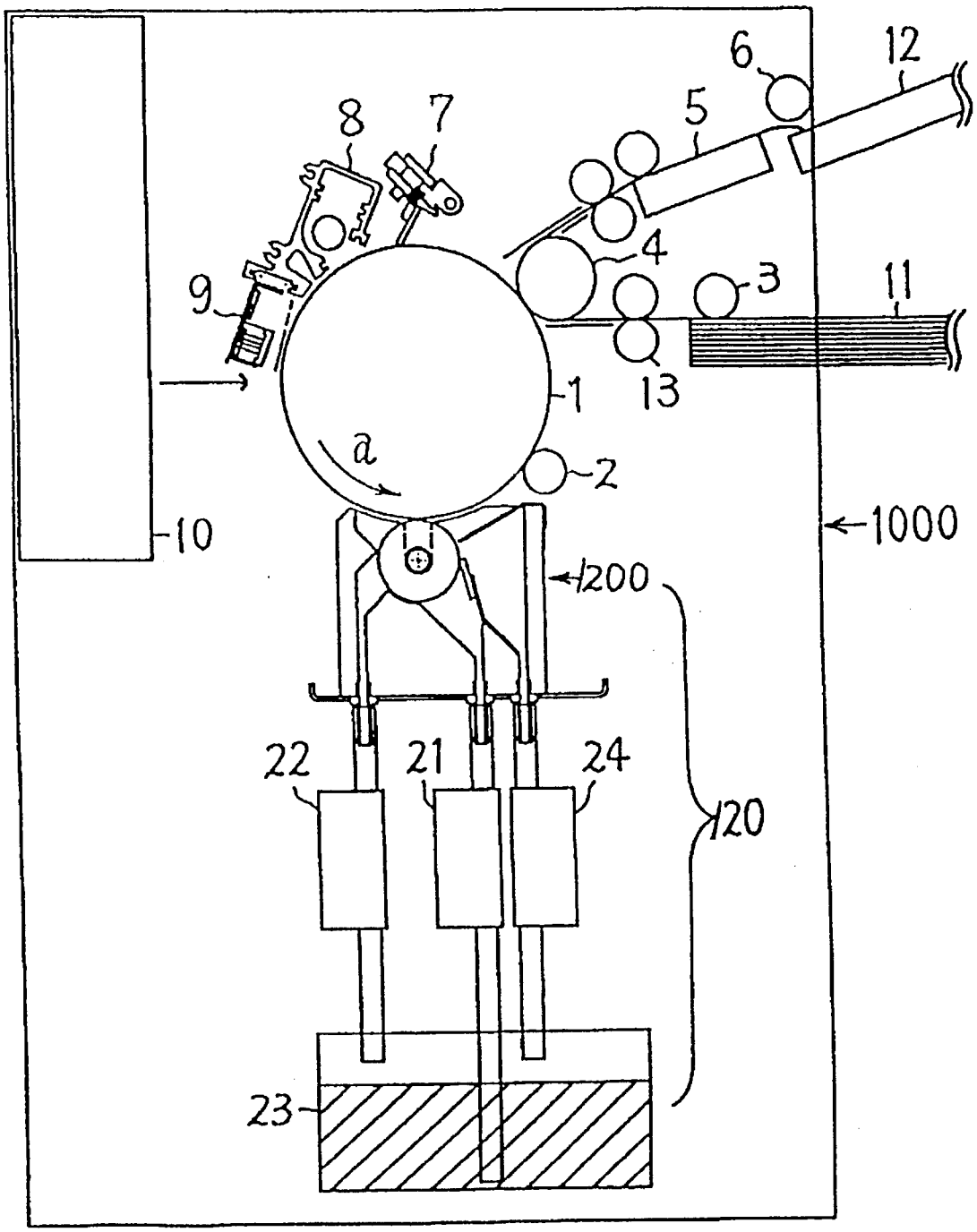
FIG. 5 is a cross-sectional view of an electrophotographic printer 1000 incorporating the liquid-type developing device 20 to which this invention was applied.

FIG. 5 is a cross-sectional view of an electrophotographic printer 1000 incorporating the liquid-type developing device of another example related to this invention. As shown in FIG. 5, the liquid-type developing device 120 comprises a liquid-type developer storage tank 23 to store liquid-type developer, a liquid supply device 21 that draws up liquid-type developer inside the liquid-type developer storage tank 23, a developing head 1200 opposite the photoreceptor drum 1 that develops the electrostatic latent image on the photoreceptor 1 using the liquid-type developer supplied by means of the liquid supply device 21, and a liquid transport device 22 and a remaining liquid transport device 24 to return liquid-type developer inside the developing head 1200 to the liquid-type developer storage tank 23. Moreover, the liquid-type developer inside the liquid-type developer storage tank 23 is maintained at an almost even toner density and liquid quantity by means of a toner supply device (not shown in figure) supplying toner and carrier solution when required. Furthermore, the basic construction of the printer 1000 shown in FIG. 5 is identical to the printer 100 shown in FIG. 1. Therefore, like reference numbers are provided for common construction with the description omitted.

Figure 6:
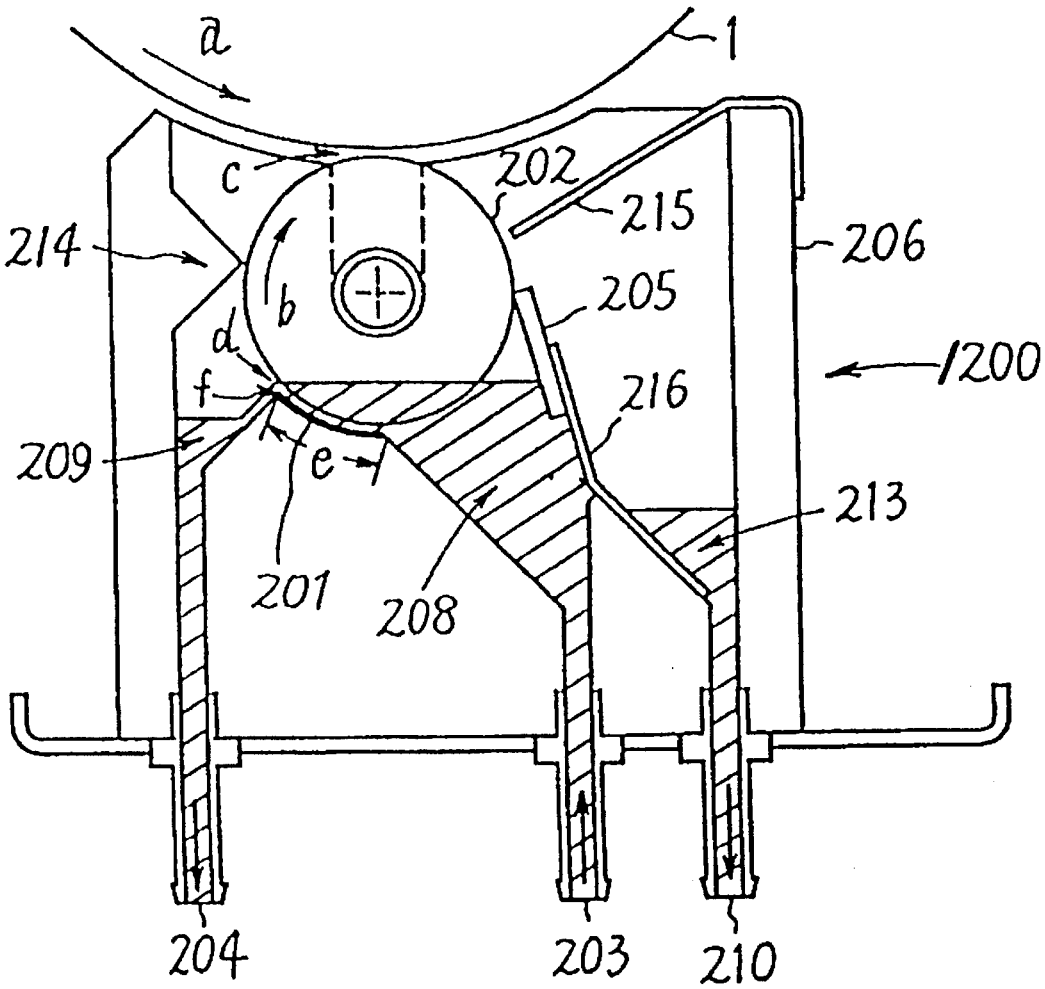
FIG. 6 is an enlarged view of the periphery of the developing head 1200 of the liquid-type developing device 120.

FIG. 6 is an enlarged view of the periphery of the developing head 1200. As shown in FIG. 6, the developing head 1200 comprises a developing roller 202 to hold the liquid-type developer on the surface of the head, a frame 206 that supports the developing roller 202, a liquid-type developer container 208 to store liquid-type developer, a liquid collecting container 209 that collects liquid-type developer overflowing from the liquid-type developer container 208, a cleaning blade 205 to scrape off liquid-type developer remaining on the developing roller 202, and a remaining liquid collecting container 213 to collect liquid-type developer scraped off by means of the cleaning blade 205. The developing head 1200 shown in FIG. 6 has a construction common to the developing head 200 shown in FIG. 2 thus identical reference numbers are provided with the description omitted.

Figure 7:
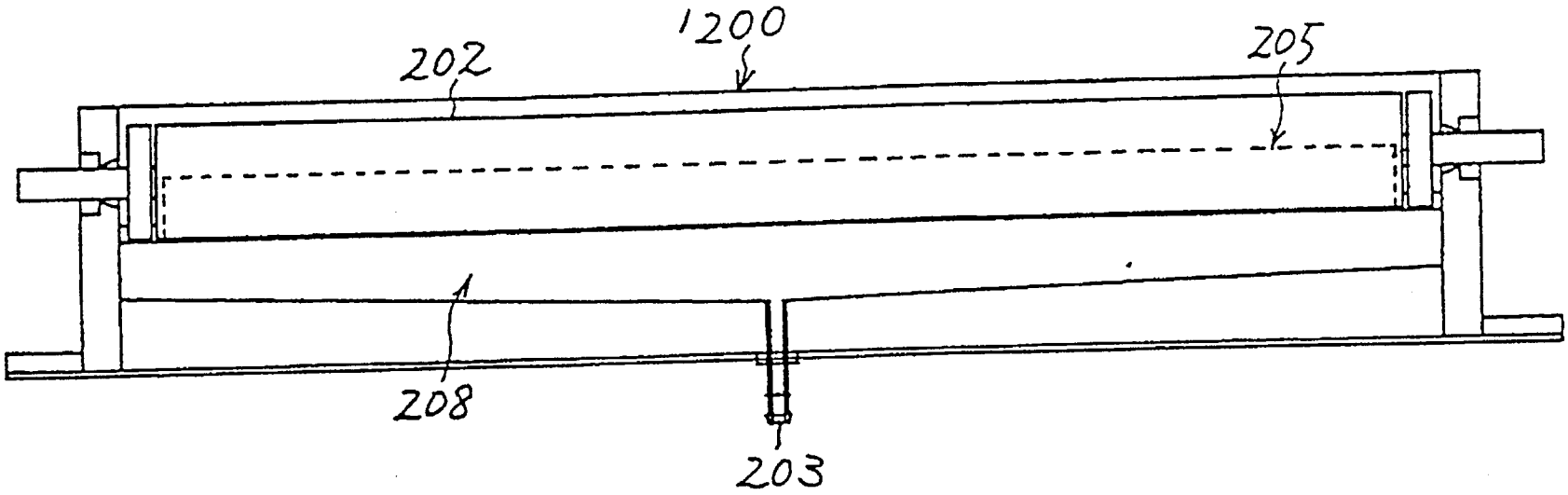
FIG. 7 shows the construction in the longitudinal direction of the developing head 1200.

FIG. 7 is a cross-sectional view of the construction in the longitudinal direction of the developing head 1200.

A remaining liquid collecting container 213 is provided adjacent to the liquid-type developer container 208 on the side opposite the liquid collecting container 209. On the bottom of the remaining liquid collecting container 213 a remaining liquid transport opening 210 is formed connected to the remaining liquid transport device 24. Liquid-type developer flowing into the remaining liquid collecting container 213 is transported through this remaining liquid transport opening 210 and returned to the liquid-type developer storage tank 23 shown in FIG. 5.

On the upper edge of the inner wall of the remaining liquid collecting container 213 a dividing panel 216 is mounted. This dividing panel 216 extends upward and forms a border between the liquid-type developer container 208 and the remaining liquid collecting container 213. The dividing panel 216 does not need to completely stop the liquid flow and if the quantity leaking from the remaining liquid collecting container 213 to the liquid-type developer container 208 compared to the quantity of liquid supplied from the liquid supply opening 203 is not that much, it can be ignored. In the concrete, if the ratio of the liquid supply quantity of the amount leaking is 1/10 or less or more preferably, 1/30 or less, there is no problem.

The cleaning blade 205 is manufactured from polyurethane rubber and is mounted to the leading edge of the dividing panel 216. The leading edge of the cleaning blade 205 faces the rotation direction of the developing roller 202 and makes contact with the surface of the developing roller 202 to scrape off liquid-type developer remaining on the developing roller 202. The scraped off liquid-type developer passes by the cleaning blade 205 and dividing panel 216 which guide it to the remaining liquid collecting container 213.

Furthermore, when the developing roller 202 is manufactured from a hard material such as metal or super hard resin, a material with soft properties such as a rubber blade can be used for the cleaning blade. In particular, a polyurethane rubber blade is preferable. Also, when the developing roller 202 is manufactured from a soft material such as NBR (nitrile rubber) roller, a hard material such as a metal blade, resin blade or ceramic blade can be used for the cleaning blade.

In the developing head 1200 shown in FIG. 6, the dividing panel 216 functions as the division between the liquid-type developer container 208 and the remaining liquid collecting container 213 as well as the support of the cleaning blade thus, the construction of the apparatus is made easier and the cost reduced. Above the liquid collecting container 209, is provided the liquid restricting member 214 that restricts the amount of the liquid-type developer held on the developing roller 202 and drops an excess quantity of liquid-type developer to the liquid collecting container 209. The liquid restricting member 214 also functions to prevent the scrapped liquid-type developer from scattering in the developing head 1200. Further, above the remaining liquid collecting container 213, an evaporation prevention panel 215 is provided to prevent evaporation of the liquid-type developer inside the developing head 200.

Next, the operation of the liquid-type developing device 120 will be described in detail.

When developing starts, the liquid supply device 21 operates and liquid-type developer is supplied from the liquid supply opening 203 to the liquid-type developer container 208. After the liquid-type developer passes through the portion d and the liquid collecting container 209, it is transported through the liquid transport opening 204 to the liquid-type developer storage tank 23 by means of the liquid transport device 22 and then the liquid-type developer is supplied to the developing head 1200 by means of the liquid supply device 21 again. In this way, the liquid-type developer circulates inside the liquid-type developing device 20 during developing.

After passing through the developing portion c, liquid-type developer remaining on the developing roller 202 is scraped off by means of the cleaning blade 205. The liquid-type developer scraped off by means of the cleaning blade 205 passes the dividing panel 216 and flows into remaining liquid collecting container 213. Therefore, liquid-type developer remaining on the developing roller 202 does not flow directly into the liquid-type developer container 208 changing the toner density of the liquid-type developer inside the liquid-type developer container 208.

Liquid-type developer which flowed into the remaining liquid collecting container 213 is transported through the remaining liquid transport opening 210 and then returned to the liquid-type developer storage tank 23 by means of the remaining liquid transport device 24.

In order to stabilize the liquid-type developer density inside the liquid-type developer storage tank 23 more, for example, after mixing the liquid-type developer which is transported by the liquid transport device 22 and the liquid-type developer which is transported by the remaining liquid transport device 24, that solution can be returned to the liquid-type developer storage tank 23 or, after the density of the liquid-type developer is close to the density of the liquid-type developer inside the liquid-type developer storage tank 23, it can be returned to the liquid-type developer storage tank 23. Furthermore, the liquid-type developer transported by the liquid transport device 22 is stored in a tank which is provided separately from the liquid-type developer storage tank 23.

Figure 8:
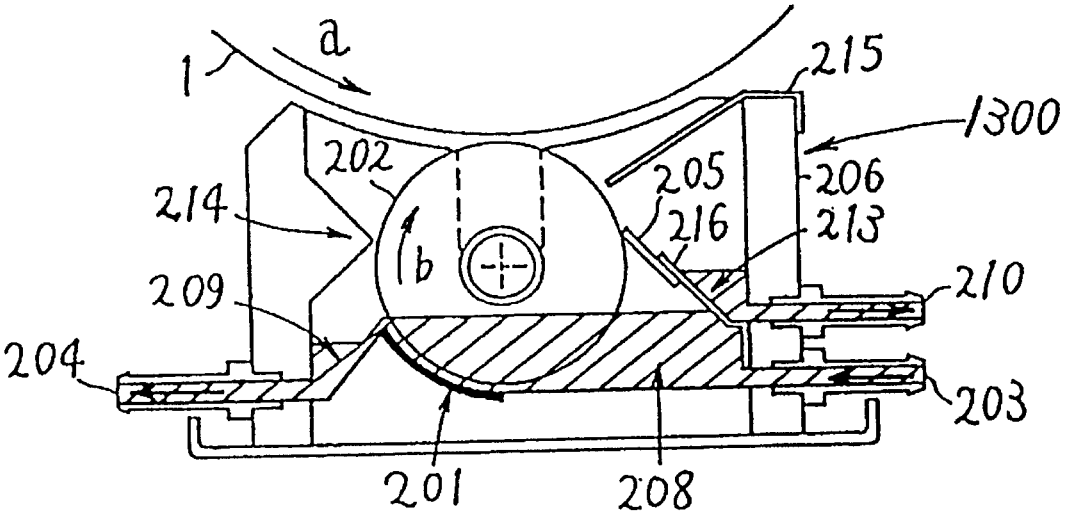
FIG. 8 shows a developing head 1300.

The developing head 1300 shown in FIG. 8 is a developing head with the shape of the liquid-type developer container 208 and the liquid collecting container 209 changed compared to the developing head 1200 in FIG. 6 matching the condition of the space. As shown in FIG. 8, the liquid supply opening 203 is provided on one side of liquid-type developer container 208 and the liquid transport opening 204 is provided on one side of liquid collecting container 209 with the inlet and outlet of liquid done from the transverse direction of each container. Further, an electrode 201, developing roller 202, cleaning blade 205, frame 206, remaining liquid transport opening 210, remaining liquid collecting container 213, liquid restricting member 214, evaporation prevention panel 215 and a dividing panel 216 are provided identical to those shown in FIG. 6.

The developing head 1300 can be used in place of the developing head 1200 in the liquid-type developing device 120 shown in FIG. 5. For this case, the arrangement of the liquid supply device 21, liquid transport device 22, liquid-type developer storage tank 23 and remaining liquid transport device 24 can be appropriately changed.

Figure 9:
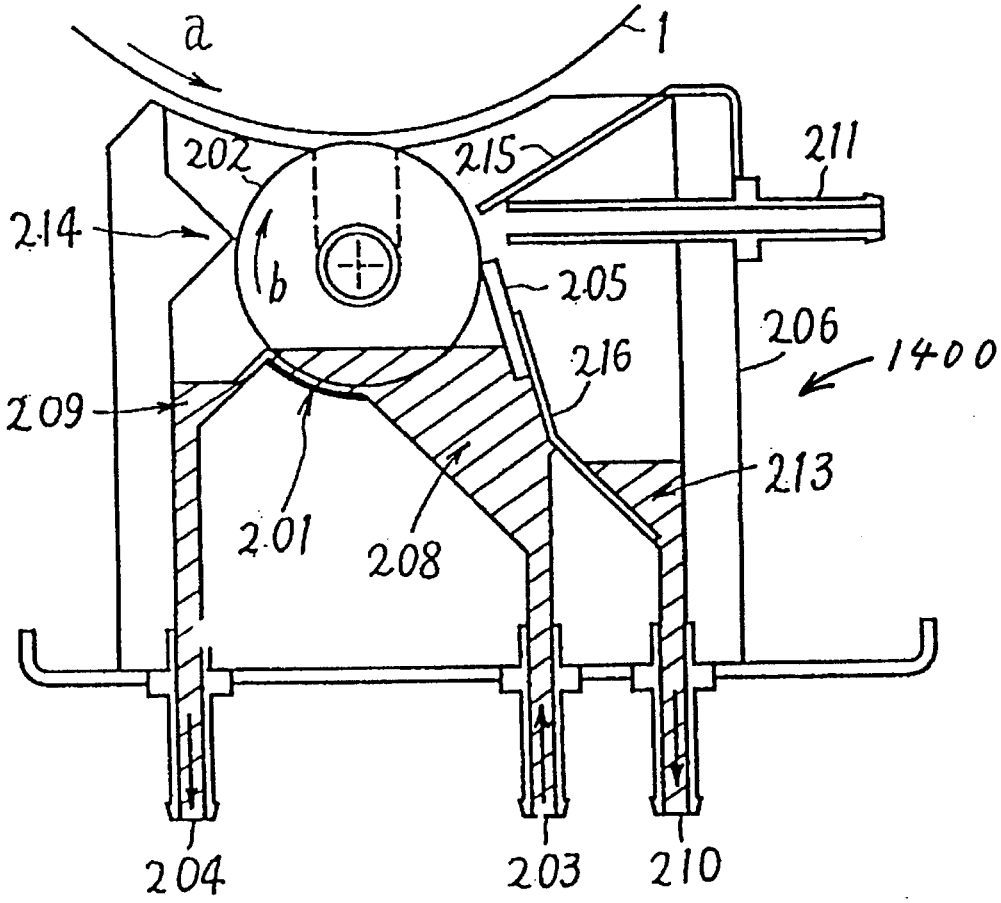
FIG. 9 shows a developing head 1400.

The developing head 1400 shown in FIG. 9 is modified the developing head 1200 in FIG. 6. The developing head 1400 has an additional mechanism to spray cleaning solution to the developing roller to make it easy to scrape off liquid-type developer remaining on the developing roller. This mechanism is identical to the spraying mechanism shown in FIGS. 1, 2, and 3.

As shown in FIG. 9, in the developing head 1400, a nozzle 211 that sprays cleaning solution on the developing roller 202 is provided on the upstream side from the cleaning blade 205 relative to the rotation direction (direction of arrow b) of the developing roller 202. As shown in FIG. 3, the tip of the nozzle 211 extends in the longitudinal direction of the developing roller 202 and has a plurality of expulsion openings.

In the developing head 1400, occurrences of remaining solution on the developing roller 202 can be prevented by means of spraying cleaning solution on the developing roller 202 as well as any increases in the rotation torque of the developing roller 202.

Figure 10:
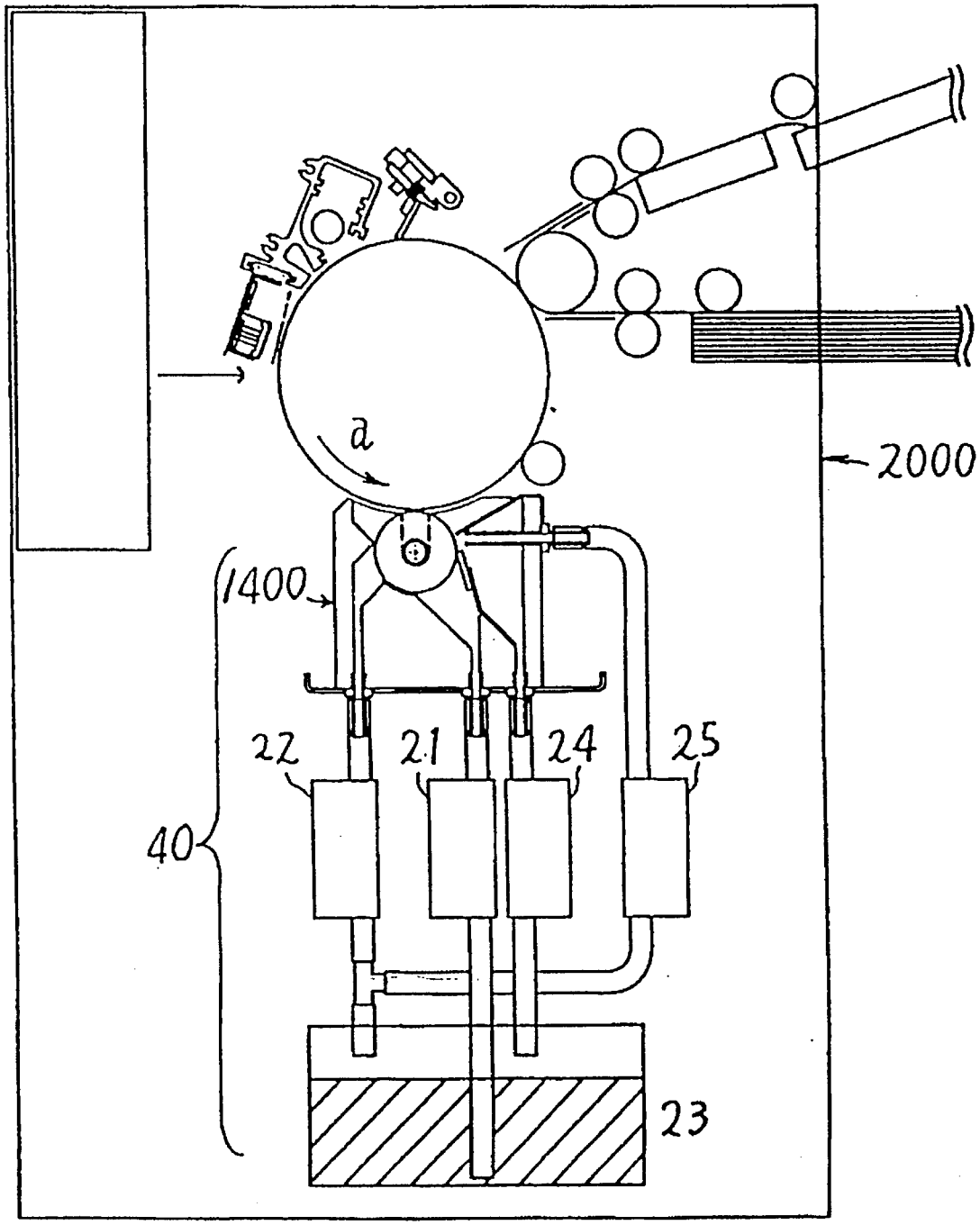
FIG. 10 is a cross-sectional view of an electrophotographic printer 2000 incorporating the liquid-type developing device 40 comprising the developing head 1400.

FIG. 10 shows the printer 2000 incorporating a liquid-type developing device 40 comprising a liquid-type developing head 1400 shown in FIG. 9. As shown in FIG. 10, the liquid-type developing device 40 comprises the liquid supply device 21, the liquid transport device 22, the liquid-type developer storage tank 23 and the remaining liquid transport device 24 corresponding to those in FIG. 5 along with being constructed to draw up one portion of the liquid-type developer returned by the liquid transport device 22 to the liquid-type developer storage tank 23 corresponding to those in FIG. 1 by means of the cleaning solution supply device 25 and then supply the liquid-type developer to the nozzle 211 of the developing head 1400 as cleaning solution. The other construction is identical to the printer 1000 shown in FIG. 5.

Furthermore, if undissolved toner is used for the cleaning solution, a number of solutions can be used allowing the liquid-type developer inside the liquid-type developer storage tank 23 to be drawn up and used, a supply liquid to stabilize the density of the liquid-type developer to be used or a special cleaning liquid to be used.

Figure 11:
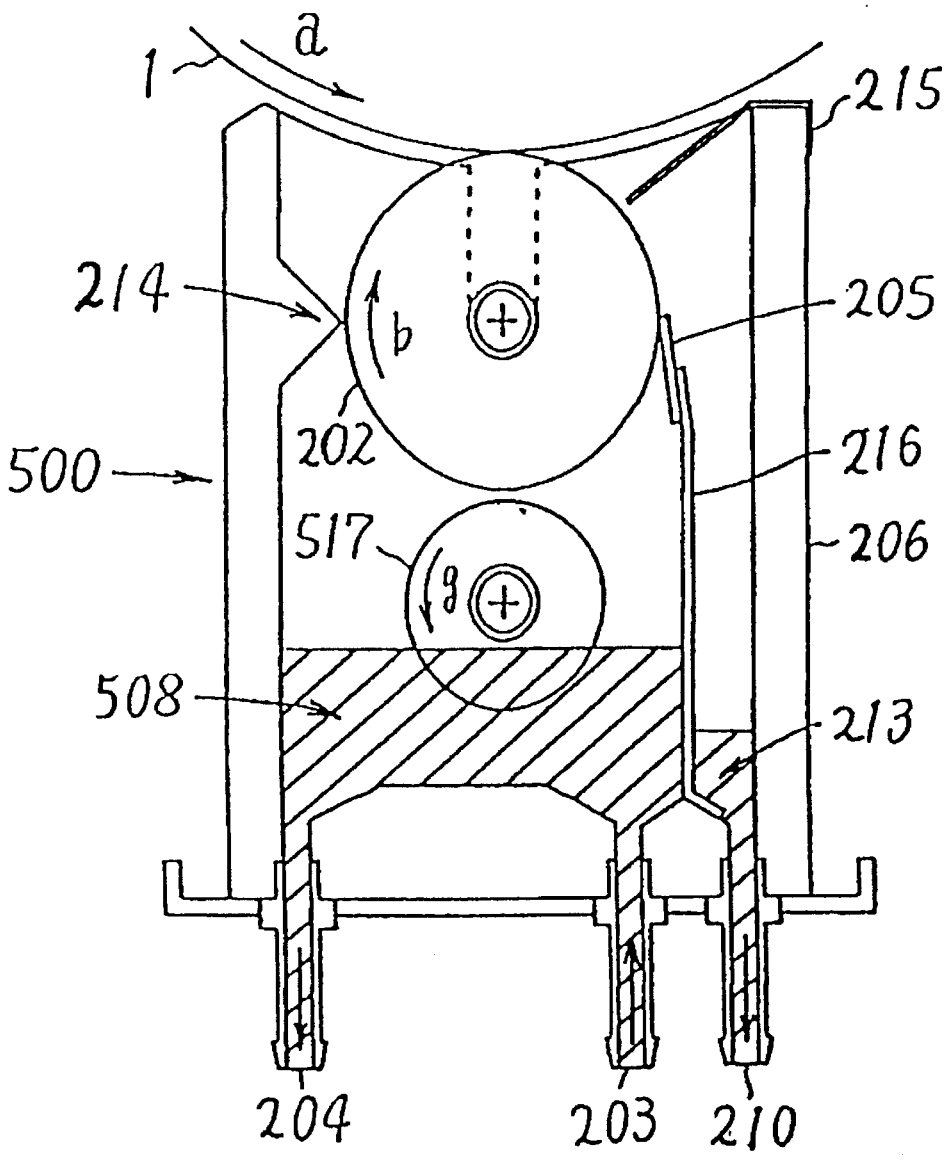
FIG. 11 shows a developing head 500.

The developing head 500 shown in FIG. 11 is modification of the developing head 1200 in FIG. 6 so that a draw up member for drawing up of the liquid-type developer and the developing roller for developing operation are separate members. This developing head 500 draws up the liquid-type developer from the liquid-type developer container 508 using a draw up roller 517 and this drawn up liquid-type developer is held on the developing roller 202 to carry out the developing.

As shown in FIG. 11, the developing head 500 comprises each identical device to the one shown in FIG. 6 including the developing roller 202, the cleaning blade 205, the remaining liquid transport opening 210, the remaining liquid collecting container 213, the liquid restricting member 214, the evaporation prevention panel 215 and the dividing panel 216 as well as a draw up roller 517 opposite the lower portion of the developing roller 202.

The draw up roller 517 is slightly separated from the developing roller 202 and is supported on the frame 206 to be rotatable in the direction of arrow g shown in the figure or, in other words, in the same direction as the rotation direction (direction of arrow b) of the developing roller in the opposing portions between the developing roller 202.

Below the draw up roller 517 a liquid-type developer container 508 is provided. In the liquid-type developer container 508 liquid-type developer is supplied from the liquid supply opening 203 and the supplied liquid-type developer is then transported from the liquid transport opening 204. By means of this action, while solution inside the liquid-type developer container 508 is being circulated, a specified quantity of liquid-type developer is stored and the lower portion of the draw up roller 517 is soaked in the liquid-type developer inside the liquid-type developer container 508.

Liquid-type developer adheres to the surface of the draw up roller 517 by means of the rotation in the direction of arrow g in the figure. This liquid-type developer is then transferred to the opposing portions between the developing roller 202 and adheres to the surface of the developing roller 202. At this time, a voltage is applied between the draw up roller 517 and the developing roller 202 drawing up the toner in the liquid-type developer to the developing roller 202. By means of this action, the liquid-type developer adheres to the developing roller in a concentrated state.

After passing through the developing region, the liquid-type developer remaining on the developing roller 202 is scraped off by means of the cleaning blade 205, flows into the remaining liquid collecting container 213 passing by the cleaning blade 205 and dividing panel 216 and is transported from the remaining liquid transport opening 210.

Figure 12:
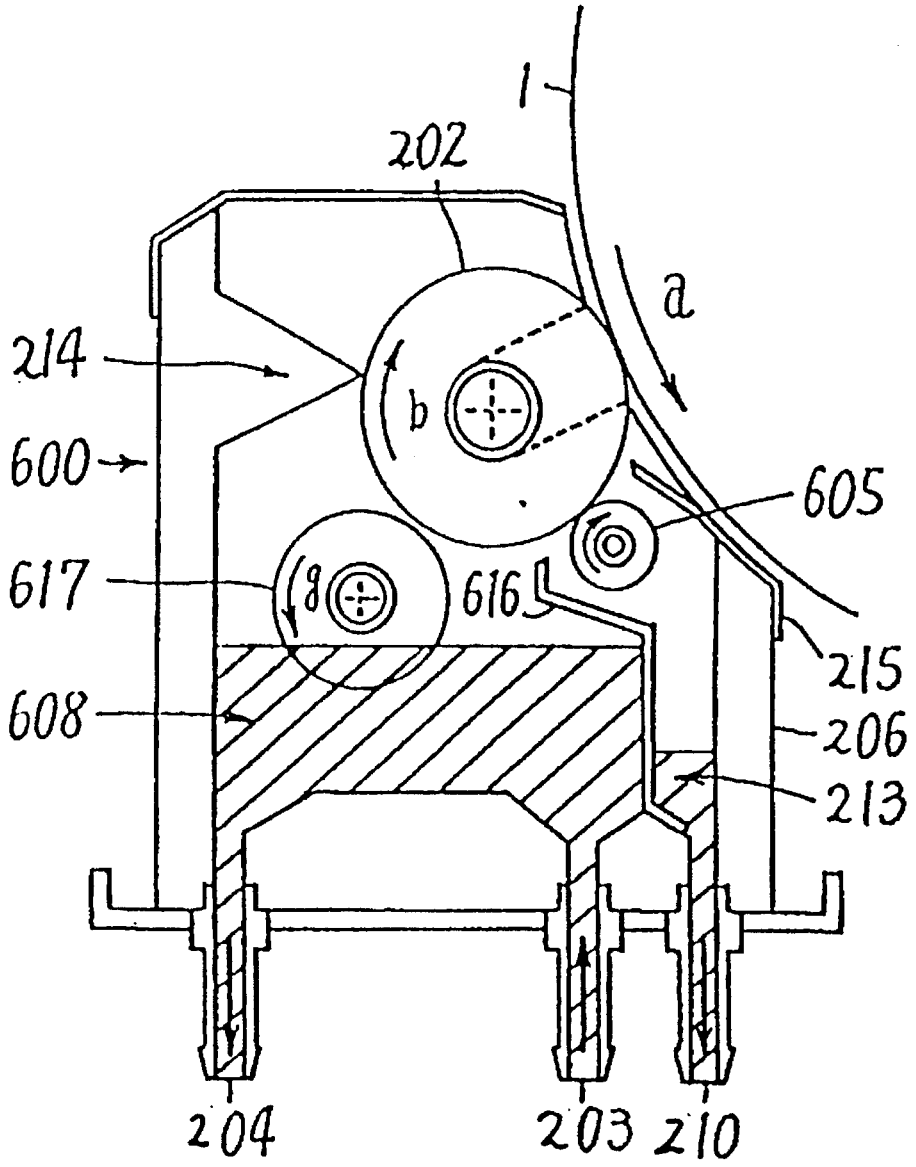
FIG. 12 shows a developing head 600.

A developing head 600 shown in FIG. 12 is modification of the developing head 1200 in FIG. 6 so that a cleaning roller 605 in place of the cleaning blade scrapes off residual liquid-type developer on the surface of the developing roller. As shown in FIG. 12, the developing head 600 comprises the developing roller 202, the liquid supply opening 203, the liquid transport opening 204, the frame 206, the liquid-type developer container 608, the remaining liquid transport opening 210, the remaining liquid collecting container 213, the liquid restricting member 214, the evaporation prevention panel 215, the dividing panel 616 and the draw up roller 617 identical to each one in FIG. 11. Further, the developing head 600 is constructed such that the developing roller 202 makes contact with the side of the photoreceptor 1.

The cleaning roller 605 to scrape off liquid-type developer remaining on the developing roller 202 is provided on the downstream side of the opposing portions between the photoreceptor drum 1 and the developing roller 202 relative to the rotation direction (direction of arrow b in the figure) of the developing roller 202. The cleaning roller 605 is metallic and rotates in the direction opposite to the developing roller 202 in the opposing portions between the developing roller 202 making contact with the developing roller 202 and scraping off the liquid-type developer. Further, the cleaning roller may be kept in a non-contact state and by applying a voltage, attract the liquid-type developer to the cleaning roller 605 to scrape the liquid-type developer off.

The upper edge of the dividing panel 616 is adjacent to the lower portion of the cleaning roller 605 to guide the liquid-type developer which was scraped off by the cleaning roller 605 into the remaining liquid collecting container 213.

Although the examples shown from FIG. 5 to FIG. 12 are effective when attracting toner to the surface of the developing roller by a static electric force using a voltage applied to the developing roller, they are also effective in a developing apparatus in which developing is carried out by only adhering the liquid-type developer to the developing roller to draw up the liquid-type developer and then forcing this agent to make contact with the photoreceptor, using, for example, a liquid-type developer with a high toner density.

<Composition of liquid-type developer>

The liquid-type developer contains at least a liquid medium and toner particles which are used as the liquid medium. Furthermore, in addition to these, the liquid-type developer can also contain agents to provide the functions such as a charge control agent, a dispersal agent and a dispersal stabilization agent.

It is preferable to adjust the volume average particle size of said toner particles from 0.5 μm to 5 μm. Moreover, with respect to toner particles in such a proportion of 80% by weight relative to 100 parts of the toner particles, it is preferable to adjust the volume average particle size of the toner particles within the range of ±1 μm, and preferably within the range of ±0.5 μm. The volume average particle size and the particle size distribution can be measured using a particle size distribution measurement apparatus (SALD-1100: Shimadzu Corp.).

Polymer micro-particles obtained by means of a dry manufacturing method and wet manufacturing method can be used for said toner particles. The dry manufacturing method includes a dry grinding method and a dry atomization method while the wet manufacturing method includes a grinding in solution method, a suspension polymerization method, an emulsion polymerization method, a non aqueous dispersal polymerization method, a seed polymerization method and an emulsion dispersal particle formation method. In particular, it is preferable to use polymer micro-particles manufactured by means of the emulsion dispersal particle formation method or dry atomization method because of the varieties of resins used, ease of adjusting particle quantity, resin blendability and sharpness of particle size distribution. To economically manufacture toner particles the grinding in solution method is preferable.

The emulsion dispersal particle formation method is a method that manufactures polymer micro-particles by means of carrying out emulsion dispersal within an aqueous dispersal solution in a polymer solution formed by means of dissolving a polymer in a non aqueous organic medium solution forming an O/W type emulsion and then evaporating the organic medium solution by means of adding heat to the O/W type emulsion while stirring it to finally precipitate the polymer particles.

Furthermore, the dry atomization method is a method that manufactures polymer micro-particles by means of dissolving a polymer in an organic medium solution along with adjusting the polymer solution that dispersed the components of a coloring agent, etc. and then by means of injecting this polymer solution from the nozzle and heating it up, the organic medium solution is evaporated to form the polymer micro-particles.

When using this type of polymer micro-particles as toner particles of a liquid-type developer, already known charge control agents, dispersal aid agents and additional agents such as resins can be added as necessary after washing and drying the polymer micro-particles and then dispersed within a liquid medium with electrically insulating properties using an ultrasonic dispersal apparatus.

These is no special limitation for the resin that comprises the polymer micro-particles. Either individual resin or resins blends can be used including polyester resin, polymerized styrene acrylic, polystyrene, poly vinyl chloride, poly vinyl acetate, poly methyl methacrylate ester, polyacrylic ester, epoxy resin, polyethylene, polyurethane, polyamide and paraffin wax.

As necessary, components of coloring agent, charge control agent and offset prevention agent can be added to the polymer micro-particles.

All color pigments or dyes such as carbon black and phthalocyanine can be used for the coloring agent. If a resin has a color added to it already, pigments or dyes are not required.

For the liquid medium, if an electrically insulated organic material is used in a liquid state during developing, a state at a uniform temperature is not a problem. For example, aliphatic hydrocarbon, acrylic hydrocarbon, aromatic hydrocarbon, halogenation hydrocarbon and polysiloxane can be used although, it is preferable to use a medium solution of either normal paraffin or iso paraffin from the point of view of non-toxicity, smell, and cost.

In the concrete, it is especially preferable to use Isopar-G, Isopar-H, Isopar-L, Isopar-K (all manufactured by Exxon Co.), Shell Sol 71 (Shell Oil Co.), IP solvent 1620 and IP solvent 2028 (both manufactured by Idemitsu Sekkiyu Kagaku K.K.). Wax or paraffin can be used for the constant temperature solid body.

Further, as necessary, charge control agent, dispersal agent and dispersal stabilization agent can be added to the liquid medium.

An already known agent can be used for the charge control agent. In order to charge the toner particles at a positive polarity, a metallic salt of an organic acid such as a metallic salt of a fatty acid such as stearic acid, a metallic salt of a sulfosuccinic acid ester and a metallic salt of an abietic acid, or a dissolution polymer such as an alkyd resin adsorbed in a particle can be used. In order to charge the toner particles at a negative polarity, a surface-active agent of lecithin, a compound containing nitrogen, or a dissolution polymer such as a polyamide resin adsorbed in a particle can be used. It is preferable to add 0.0001 to 10 % and, more preferably, 0.001 to 3% of the weight of the liquid medium for these charge control agents.

Furthermore, in addition to this, a metal oxide such as $SiO_2$, $Al_2O_3$, $TiO_2$ or ZnO with a quantity almost identical to the charge control agent can be added as the charge aid agent.

For the dispersal agent and dispersal stabilization agent which stabilize the dispersal of the toner particles in the liquid-type developer, each type of said surface-active agents and dissolution polymers can be used.

There is no limitation on the dissolution polymer. However, polyolefin petroleum resin, linseed oil and polyalkyl methacrylate can be used as dissolution polymer and in order to increase the affinity with the polymer particles, a compound which is copolymerized with a slight monomer that contains a polar group such as a methacrylic acid, acrylic acid or alkyl amino ethyl methacrylate can be used. From the point of view of improving the dispersibility and preventing increases in the viscosity of the liquid medium by adding dissolution polymer, it is preferable for the added weight to be 0.01 to 20% relative to the liquid medium or more preferably, 0.1 to 1%.

Furthermore, for the surface-active agent the following can be used: a natural surface-active agent such as saponin, a nonion surface-active agent such as alkylene oxide group, glycerol group or glycidol group, and an anion group surface-active agent including an acidic group such as carboxylic acid, sulfonic acid, phosphoric acid, sulfate group and phosphate group.

The ratio (solid content ratio) of the total weight of the solid component of the toner or dispersal agent in relation to the total weight of the liquid-type developer in the liquid-type developer should be 1 to 90% of the weight. However, to reduce the total weight of the liquid-type developer used for developing to make handling easier, the solid content ratio is preferably 2 to 50% of the weight.

Experimental examples are used to describe concretely below.

<Manufacturing method of toner A>

Low molecular weight polyester resin (MW: 15000, Mn: 6000) 100 parts by weight was completely dissolved in menthylene chloride to make the density 20% of the weight. Using an Eiger motor mill (manufactured by Eiger Japan K.K.), phthalocyanine 6 parts by weight was dispersed in said resin solution as a coloring agent.

Using a Homomixer (manufactured by Tokushu Kika Kogyo K.K.), the resin solution obtained as described above was emulsion dispersed for 30 minutes at room temperature in an aqueous dispersal solution of 1% Metrose 65-SH-50 (manufactured by Shin-Etsu Chemical Co.) and 1% sodium lauryl sulfate rotating 8000 times every minute after which an O/W type emulsion was obtained. Next, the homomixer was replaced by a stirring blade with four blades and the menthylene chloride removed while stirring for 3 hours at 40° to 45° C. and an aqueous suspension solution of polymer micro-particles for toner with an volume average particle size of 2 μm was obtained.

After removing the solid portion from the obtained aqueous suspension solution of polymer micro-particles for toner using a centrifugal separator and thoroughly washing that portion with water, it was filtered and dried and resin micro-particles with an volume average particle size of 2 μm were obtained. This was designated toner A.

<Manufacturing method of toner B>

Resin micro-particles with an volume average particle size of 0.5 μm were obtained using a procedure identical to the manufacturing method of toner A but with a rotation speed of the Homomixer set to 12000 rotation every minute. This was designated toner B.

<Manufacturing method of toner C>

Resin micro-particles with an volume average particle size of 5 μm were obtained using a procedure identical to the manufacturing method of toner A but with a rotation speed of the Homomixer set to 5000 rotation every minute. This was designated toner C.

TABLE 1

| | Toner A | Toner B | Toner C |
|---|---|---|---|
| Stirring speed | 8000 rpm | 12000 rpm | 5000 rpm |
| Average particle size | 2 μm | 0.5 μm | 5 μm |

<Manufacturing method of liquid-type developer A>

Toner A 80.0 parts by weight, lauryl methacrylate methacrylic acid copolymer 26.7 parts by weight and n-hexyltrimethoxysilane 13.3 parts by weight were added to electrically insulated iso paraffin group solution IP solvent 1620 (manufactured by Idemitsu Sekkiyu Kagaku K.K.) 880 parts by weight. This was then mixed and dispersed for 20 minutes using an ultrasonic dispersal device to obtain liquid-type developer A.

<Manufacturing method of liquid-type developer B>

Liquid-type developer B was obtained using a procedure identical to the manufacturing method of liquid-type developer A but toner B was used in place of toner A.

<Manufacturing method of liquid-type developer C>

Liquid-type developer B was obtained using a procedure identical to the manufacturing method of liquid-type developer A but toner C was used in place of toner A.

<Manufacturing method of liquid-type developer D>

Using toner A 33.3 parts by weight, lauryl methacrylate methacrylic acid copolymer 11.1 parts by weight, n-hexyltrimethoxysilane 5.56 parts by weight and iso paraffin group solution IP solvent 1620 (manufactured by Idemitsu Sekkiyu Kagaku K.K.) 950 parts by weight, liquid-type developer D was obtained by the same procedure as the manufacturing method of liquid-type developer A.

<Manufacturing method of liquid-type developer E>

Using toner A 333 parts by weight, lauryl methacrylate methacrylic acid copolymer 111 parts by weight, n-hexyltrimethoxysilane 55.6 parts by weight and iso paraffin group solution IP solvent 1620 (manufactured by Idemitsu Sekkiyu Kagaku K.K.) 500 parts by weight, liquid-type developer E was obtained by the same procedure as the manufacturing method of liquid-type developer A.

Toner particles within each liquid-type developer manufactured in this way are all charged with a positive polarity.

TABLE 2

| | Liquid-type developer A | Liquid-type developer B | Liquid-type developer C | Liquid-type developer D | Liquid-type developer E |
|---|---|---|---|---|---|
| Toner | Toner A 80.0 g | Toner B 80.0 g | Toner C 80.0 g | Toner A 33.3 g | Toner A 333 g |
| lauryl methacrylate methacrylic acid copolymer | 26.7 g | 26.7 g | 26.7 g | 11.1 g | 111 g |
| n-hexyltrimethoxysilane | 13.3 g | 13.3 g | 13.3 g | 5.56 g | 55.6 g |
| Carrier solution | 880 g | 880 g | 880 g | 950 g | 500 g |
| Solid content ratio | 12 wt % | 12 wt % | 12 wt % | 5 wt % | 50 wt % |

Next, an experiment to confirm the effect when cleaning solution is sprayed before scraping off the liquid-type developer will be described.

<Experiment 2>

1,000 continuous prints were taken by means of setting liquid-type developer A in the electrophotographic printer 100 of FIG. 1 which incorporates the liquid-type developing device 20 shown in FIG. 2 and carrying out reverse developing under the conditions shown below.

Ten-point surface roughness of the developing roller: 2 μm

Developing gap: 200 μm

Voltage applied to developing roller: +550 V

Thin layer forming gap: 1 mm

Voltage applied to electrode: +1550 V (Voltage applied to thin layer forming gap: 1000 V)

Liquid flowrate: 200 cc/min

Length of developing region in longitudinal direction of developing roller: 320 mm photoreceptor rotation speed: 20 cm/s Developing roller rotation speed: 20 cm/s photoreceptor surface potential of non-exposed areas: +750 V Photoreceptor surface potential of exposed areas: +50 V Diameter of developing roller: 30 mm Ø

Flowrate of cleaning solution: 20 cc/min

<Comparison 1>

The experiment was carried out under conditions identical to experiment 1 except for a flowrate of cleaning solution of 0 cc/min or, in other words, that the cleaning solution was not sprayed.

<Evaluation of remaining solution>

The condition of the surface of the developing roller after passing through the cleaning blade was visually examined to check whether any cleaning solution was remaining.

<Evaluation of torque>

A torque measurement device was included in place of a motor to drive the developing roller and then the torque required to drive the developing roller was measured when developing is done under the above conditions.

Table 3 shows the experiment results.

TABLE 3

| | Rotation torque (kgcm) | Existence of remaining solution |
|---|---|---|
| Experiment 1 | 0.7 | No |
| Comparison 1 | 1.0 | 2 occurrences of line-shaped remaining solution |

As shown in Table 3, remaining solution did not occur in experiment 1. In contrast to this, line-shaped remaining solution was recognized in the comparison 1. Moreover, in the comparison 1, the rotation torque increased compared to the tone in the experiment 1. In the comparison 1, toner accumulated on the edge of the blade and because of this, pressure was exerted on the blade which can be considered to be the cause of the torque increase. Also, occurrence of blade wear due to this as well as a factor of the occurrence of remaining solution can be considered.

As described above, when spraying a solution on the liquid-type developer holding member to make it easy to scrape off toner, occurrences of remaining solution while scraping off any liquid-type developer remaining on the liquid-type developer holding member by means of the cleaning blade are suppressed. Further, increases in the torque to rotate the developing roller are suppressed as well.

Next, an experiment to confirm the effect when preventing liquid-type developer remaining on the liquid-type developer holding member from dropping into the liquid-type developer container will be described.

<Experiment 2>

Reverse developing was carried out under the conditions below by means of setting liquid-type developer A in the printer 1000 of FIG. 5 incorporating the liquid-type developing device 120 comprising the developing head 1200 of FIG. 6. The printing conditions during this time are shown below. Further, the image data used will be described later.

Ten-point surface roughness of the developing roller: 2 μm

Developing gap: 200 μm

Voltage applied to developing roller: +550 V

Thin layer forming gap: 1 mm

Voltage applied to electrode: +1550 V (Voltage applied to thin layer forming gap: 1000 V)

Liquid flowrate: 200 cc/min

Length of developing region in longitudinal direction of developing roller: 320 mm Photoreceptor rotation speed: 20 cm/s Developing roller rotation speed: 20 cm/s Photoreceptor surface potential of non-exposed areas: +750 V Photoreceptor surface potential of exposed areas: +50 V Diameter of developing roller: 30 mm Ø

<Experiment 3>

This experiment was carried out under the same conditions as experiment 2 but using liquid-type developer B in place of liquid-type developer A.

<Experiment 4>

This experiment was carried out under the same conditions as experiment 2 but using liquid-type developer C in place of liquid-type developer A.

<Experiment 5>

This experiment was carried out under the same conditions as experiment 2 using liquid-type developer D in place of liquid-type developer A but with liquid flowrate of 480 cc/min.

<Experiment 6>

This experiment was carried out under the same conditions as experiment 2 using liquid-type developer E in place of liquid-type developer A but with liquid flowrate of 48 cc/min.

<Experiment 7>

This experiment was carried out under the same conditions as experiment 2 but with a developing gap of 0 (zero).

<Experiment 8>

This experiment was carried out under the same conditions as experiment 2 but with a rotation speed of the developing roller set to 3 times normal speed.

<Experiment 9>

Reverse developing was carried out under the same conditions as experiment 2 by means of setting liquid-type developer A in the printer 2000 of FIG. 10 which incorporates the liquid-type developing device 40 comprising the developing head 1400 of FIG. 9. However, the flowrate of the cleaning solution was 20 cc/min.

<Comparison 2>

For the purpose of a comparison, the experiment was carried out using a type of liquid-type developing device in which the liquid-type developer remaining on the developing roller which has been scraped off is not separated and recovered but flows into the liquid-type developer container.

The experiment was carried out under the same conditions as experiment 2 but without the cleaning solution being sprayed on the developing head 1200 of the printer 1000 shown in FIG. 5 in place of the developing head 200 shown in FIG. 2.

<Image evaluation>

Figure 13:
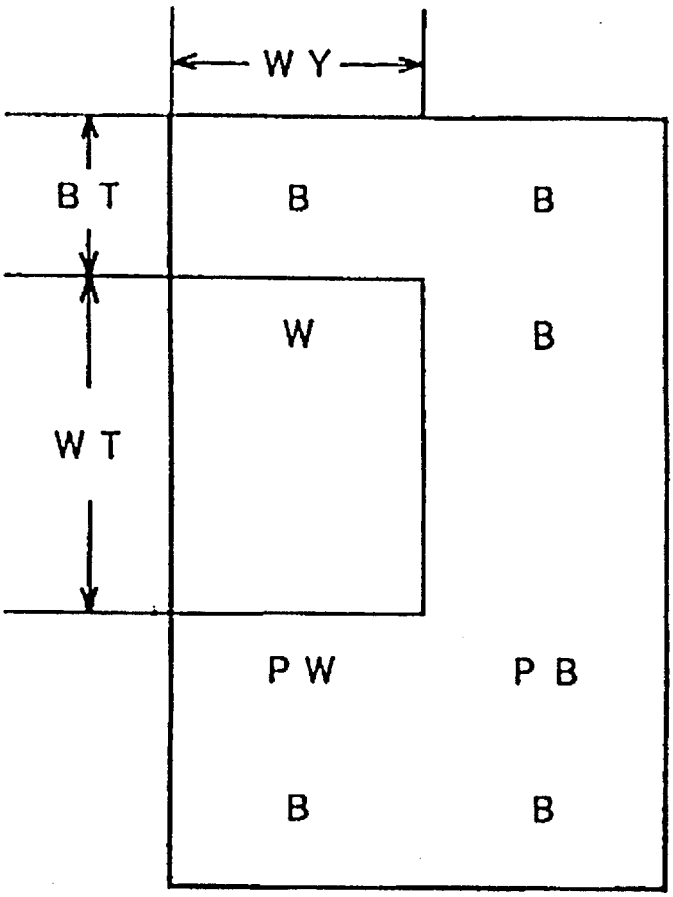
FIG. 13 shows an output pattern of image data used to evaluate image density.

FIG. 13 shows an output pattern of image data. The image evaluations of each experiment and comparison were done using the output pattern shown in FIG. 13. As shown in FIG. 13, this output pattern is almost A3 size. The longitudinal direction of the figure is proportional to the rotation direction of the photoreceptor drum 1 and the horizontal direction of the figure is proportional to the longitudinal direction of the photoreceptor. The output pattern then forms starting from the top of the figure moving downward in order.

This output pattern is composed of the white portion and the black portion. In the FIG. 13, B designates the black portion and W designates the white portion. The width WY of the white portion is 149 mm and the length WT of the white portion is 189 mm. The length BT of the black portion is 95 mm.

BT is proportional to 1 rotation of the developing roller. Further, WT is proportional to 2 rotations of the developing roller 202.

An image was formed using this output pattern and the portion corresponding to the PB black portion and the PW black portion, namely, toner adhering to the surface of the photoreceptor of the portion corresponding to the 4th rotation of the developing roller was dried, the weight scraped off by means of the polyurethane rubber blade was measured and then the weight at each unit area was calculated. The above results are shown in Table 4.

TABLE 4

| | Developing apparatus | Developing gap | Liquid-type developer | Developing roller rotation rate |
|---|---|---|---|---|
| Embodiment 2 | FIG. 6 | 200 μm | A | 1 |
| Embodiment 3 | FIG. 6 | 200 μm | B | 1 |
| Embodiment 4 | FIG. 6 | 200 μm | C | 1 |
| Embodiment 5 | FIG. 6 | 200 μm | D | 1 |

TABLE 4-continued

| | | | | |
|---|---|---|---|---|
| Embodiment 6 | FIG. 6 | 200 μm | E | 1 |
| Embodiment 7 | FIG. 6 | 0 μm | A | 1 |
| Embodiment 8 | FIG. 6 | 200 μm | A | 3 |
| Embodiment 9 | FIG. 9 | 200 μm | A | 1 |
| Comparison 2 | FIG. 2 | 200 μm | A | 1 |

| | PB portion adhere quantity ($mg/cm^2$) | PW portion adhere quantity ($mg/cm^2$) | Adhere quantity differ-ence ($mg/cm^2$) | Image density |
|---|---|---|---|---|
| Embodiment 2 | 0.4 | 0.4 | 0 | excellent |
| Embodiment 3 | 0.3 | 0.3 | 0 | excellent |
| Embodiment 4 | 0.5 | 0.5 | 0 | excellent |
| Embodiment 5 | 0.4 | 0.4 | 0 | excellent |
| Embodiment 6 | 0.4 | 0.4 | 0 | excellent |
| Embodiment 7 | 0.4 | 0.4 | 0 | excellent |
| Embodiment 8 | 0.4 | 0.4 | 0 | excellent |
| Embodiment 9 | 0.4 | 0.4 | 0 | excellent |
| Comparison 2 | 0.4 | 1.0 | 0.6 | unevenness |

As shown in Table 4, the experiments have no difference in the toner adhering quantity at the PB position and the PW position and show excellent characteristics without any image density unevenness. In the comparison 2, a quantity of toner adhering at the PW position larger than the PB position could be seen and image density unevenness had occurred.

As described above, in the examples shown in FIG. 6 through FIG. 12, liquid-type developer remaining on the liquid-type developer holding member does not drop into the liquid-type developer container below the liquid-type developer holding member. Consequently, density unevenness of the liquid-type developer inside the liquid-type developer container is suppressed. This action makes it possible to prevent occurrences of density unevenness of the liquid-type developer being supported on the liquid-type developer holding member in addition to allowing an image without any density unevenness to be finally obtained.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A liquid-type developing device which develops an electrostatic latent image on an electrostatic latent image carrier with a liquid-type developer, said liquid-type developing device comprising:

a developer carrying member which transports the liquid-type developer held on the surface thereof, the liquid-type developer being supplied to the surface of the electrostatic latent image carrier at a developing region wherein the developer carrying member confronts the electrostatic latent image carrier;

a removing member which removes the liquid-type developer remained on the surface of the developer carrying member after development; and a fluid supplying member which supplies a fluid on the surface of the developer carrying member, said fluid supplying member being located between the developing region and the removing member.

2. A liquid-type developing device as claimed in claim 1, wherein said fluid supplying member sprays the fluid on the surface of the developer carrying member.

3. A liquid-type developing device as claimed in claim 1, further comprising:

a supply member which supplies said liquid-type developer to the surface of said developer carrying member after removing the liquid-type developer.

4. A liquid-type developing device as claimed in claim 3, wherein said supply member includes an electrode opposed to the surface of said developer carrying member, and a bias voltage is applied to said electrode so that said developer carrying member attracts a toner which is dispersed in said liquid-type developer.

5. A liquid-type developing device as claimed in claim 3, wherein said supply member includes a supply roller opposed to the surface of said developer carrying member.

6. A liquid-type developing device as claimed in claim 1, wherein said fluid is said liquid-type developer.

7. A liquid-type developing device as claimed in claim 1, wherein said fluid is composed of a carrier liquid and a charge controlling agent.

8. A liquid-type developing device which develops an electrostatic latent image on an electrostatic latent image carrier with a liquid-type developer, said liquid-type developing device comprising:

a developer carrying member which transports the liquid-type developer held on the surface thereof, the liquid-type developer being supplied to surface of the electrostatic latent image carrier at a developing region wherein the developer carrying member confronts the electrostatic latent image carrier;

a container containing the liquid-type developer which is supplied to the surface of the developer carrying member; and a developer collecting device which collects a residual developer from the surface of the developer carrying member and accommodates therein.

9. A liquid-type developing device as claimed in claim 8, further comprising:

a fluid supplying member which supplies a fluid on the surface of the developer carrying member, said fluid supplying member being located between the developing region and the developer collecting device.

10. A liquid-type developing device as claimed in claim 8, further comprising:

a supply member provided in the container and supplying the developer from the container to the surface of said developer carrying member.

11. A liquid-type developing device as claimed in claim 10, wherein said supply member includes an electrode opposed to the surface of said developer carrying member, and a bias voltage is applied to said electrode so that said developer carrying member attracts a toner which is dispersed in said liquid-type developer.

12. A liquid-type developing device as claimed in claim 10, wherein said supply member includes a supply roller opposed to the surface of said developer carrying member.

13. A liquid-type developing device as claimed in claim 8, wherein said developer collecting device includes a developer removing member which removes the liquid-type developer remained on the surface of the developer carrying member.

14. A liquid-type developing device which develops an electrostatic latent image on an electrostatic latent image carrier with a liquid-type developer, said liquid-type developing device comprising:

a developer carrying member which transports the liquid-type developer held on the surface thereof, the liquid-type developer being supplied to surface of the electrostatic latent image carrier at a developing region wherein the developer carrying member confronts the electrostatic latent image carrier;

a supply member which supplies the liquid-type developer to the surface of the developer carrying member, and said supply member being located at a downstream side from the developing region with respect to a transporting direction of the developer carrying;

a developer restricting member which restricts the amount of the liquid-type developer on the surface of the developer carrying member, and said developer restricting member being located at a downstream side from the supply member with respect to a transporting direction of the developer carrying; and a container divided into a first portion and a second portion, said container containing the liquid-type developer and being located at a downstream side from the developing region with respect to a transporting direction of the developer carrying member, said first portion containing the supply member and accommodating the liquid-type developer to be supplied to the developer carrying member, said second portion being located between the supply member and the developer restricting member and collecting an excess amount of the liquid-type developer which is restricted by the developer restricting member.

15. A liquid-type developing device as claimed in claim 14, further comprising:

a removing member being located at between the developing region and the first portion of the container, said removing member removing the liquid-type developer remained on the surface of the developer carrying member.

16. A liquid-type developing device as claimed in claim 15, further comprising:

a fluid supplying member which supplies a fluid on the surface of the developer carrying member, said fluid supplying member being located between the developing region and the removing member.

17. A liquid-type developing device as claimed in claim 15, further comprising:

a second container which accommodates a residual developer which is removed from the surface of the developer carrying member by the removing member.

18. A liquid-type developing device as claimed in claim 14, further comprising:

a storetank which stores the liquid-type developer;

a supply device which is disposed between said storetank and the first portion of the container, and said supply device which supplies the liquid-type developer from said storetank to the first portion of the container; and a transport device which is disposed between said storetank and the second portion of the container, and said transport device which transports the liquid-type developer from the second portion of the container to said storetank.

19. A liquid-type developing device as claimed in claim 18, further comprising:

a supplying inlet which is provided at the first portion of the container and through which the liquid-type developer is supplied from the storetank to the first portion of the container by said supply device; and a transport outlet which is provided at the second portion of the container and through which the liquid-type developer is transported from the second portion of the container to the storetank by said transport device;

wherein said supplying inlet and said transport outlet are horizontally provided in the developing liquid container.

20. A liquid-type developing device as claimed in claim 18, further comprising:

a fluid supplying member which supplies the liquid-type developer on the surface of the developer carrying member, and said liquid-type developer which is accommodated in the second portion of the container.

21. A liquid-type developing device as claimed in claim 20, further comprising:

a second container which collects a residual developer which is removed from the surface of the developer carrying member by the removing member, said residual developer which is included said liquid-type developer which is supplied fluid supplying member.

22. A liquid-type developing device as claimed in claim 14, wherein said supply member includes an electrode opposed to the surface of said developer carrying member, and a bias voltage is applied to said electrode so that said developer carrying member attracts a toner which is dispersed in the liquid-type developer.

23. A liquid-type developing device as claimed in claim 14, wherein said supply member includes a supply roller opposed to the surface of said developer carrying member.

* * * * *